United States Patent [19]

Vaughn

[11] 4,150,453

[45] Apr. 24, 1979

[54] METHOD AND APPARATUS FOR APPLYING A BOOK COVER

[75] Inventor: Wade Vaughn, Seattle, Wash.

[73] Assignee: Norfin, Inc., Seattle, Wash.

[21] Appl. No.: 800,287

[22] Filed: May 25, 1977

[51] Int. Cl.[2] ..... B42C 11/02; B42C 11/04

[52] U.S. Cl. ..... 11/3; 11/1 AD; 11/4; 156/311; 156/477 B; 156/498; 281/21 R

[58] Field of Search ..... 11/1 AD, 1 R, 3, 4, 11/5; 156/282, 311, 477 B, 498; 281/21 R, 29

[56] References Cited

U.S. PATENT DOCUMENTS

| | | | |
|---|---|---|---|
| 3,840,254 | 10/1974 | Shatzkin | 281/21 R |
| 3,953,277 | 4/1976 | K uhns | 11/1 AD |

*Primary Examiner*—Robert Louis Spruill
*Attorney, Agent, or Firm*—Dowrey & Cross

[57] ABSTRACT

The book cover applicator is suitable for use in applying covers to multiple sheet fillers which have been secured together along the spine by a hotmelt adhesive. The applicator comprises means for holding the filler and cover at a bonding station and bonding means mounted adjacent the bonding station, the bonding means including a heater bar for applying heat to melt the hotmelt adhesive, and a set bar for holding the cover square up against the filler and conducting heat away from the adhesive for a fast and perfect set. The hotmelt adhesive provides a strong, flexible bond between the filler spine and the cover.

15 Claims, 12 Drawing Figures

FIG. 3
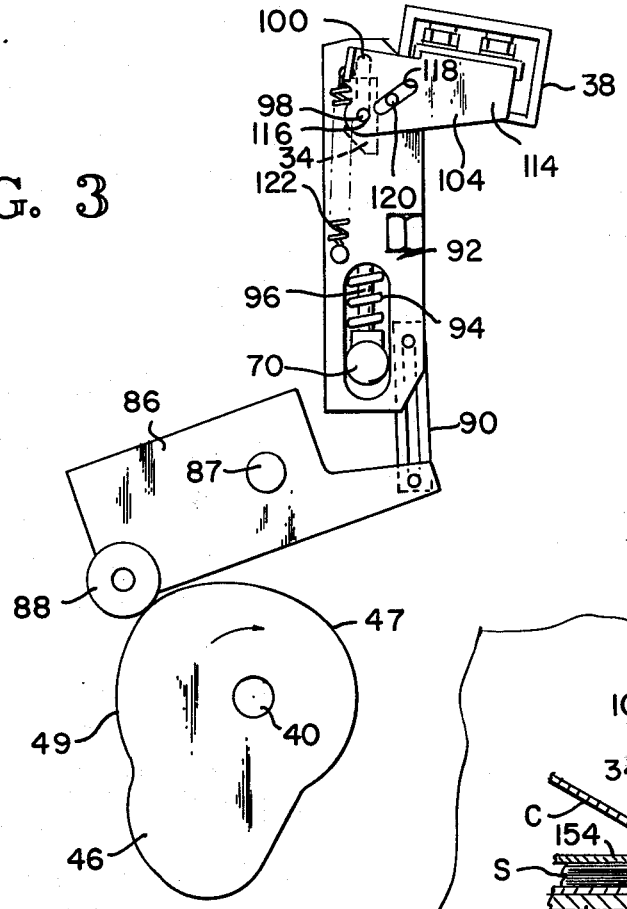
FIG. 5
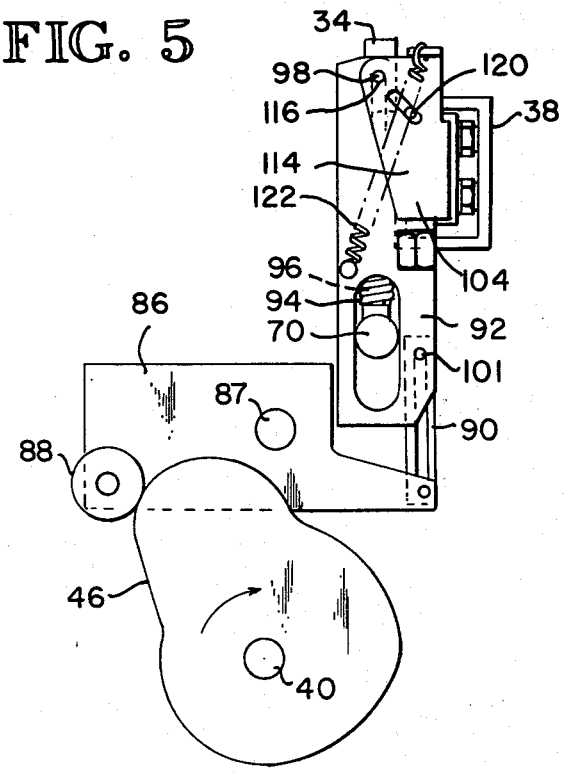
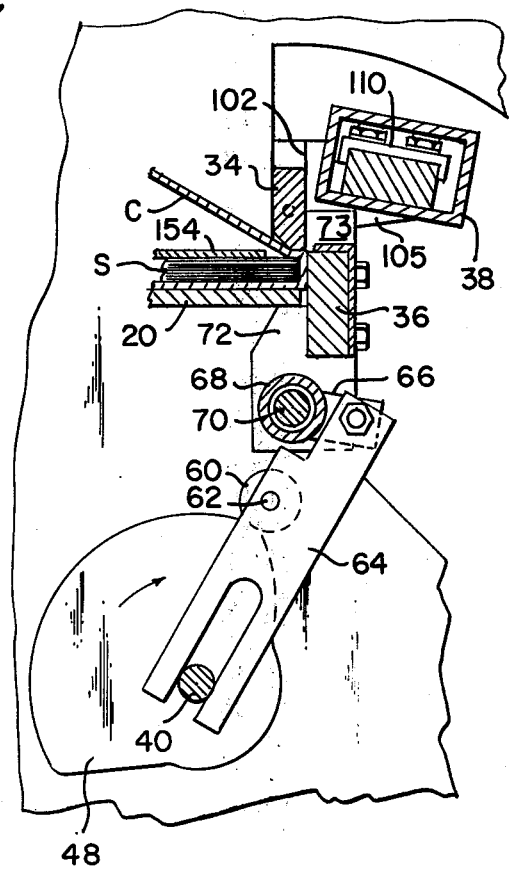
FIG. 4

FIG. 9
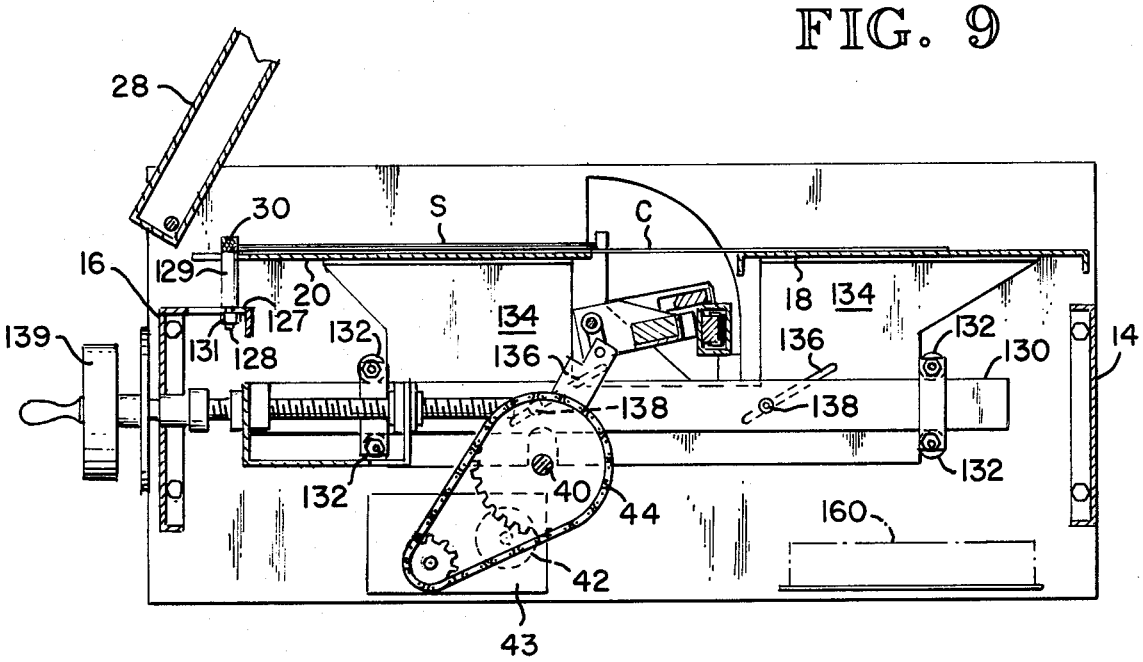
FIG. 10
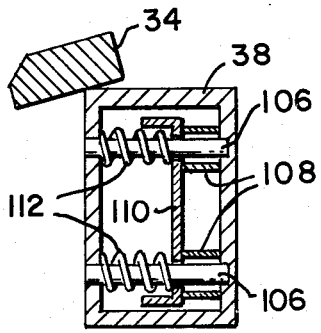
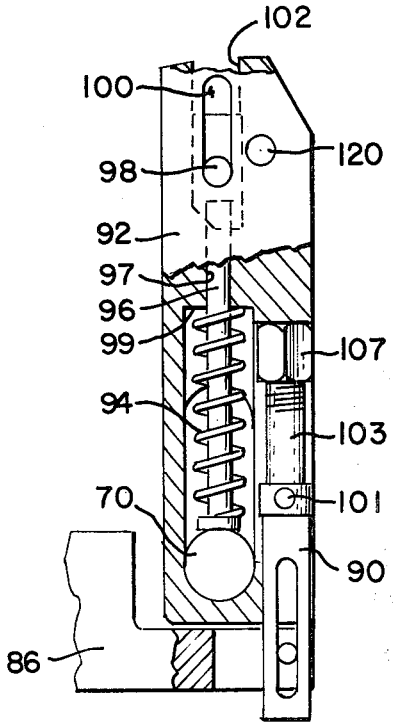
FIG. 11

METHOD AND APPARATUS FOR APPLYING A BOOK COVER

BACKGROUND OF THE INVENTION

This invention relates to bookbinding and, more particularly, to book cover applicators for applying covers to fillers or book blocks which may be made up of a stack of sheets, signatures or folios which have been secured together along one edge. The invention is suitable for use in making hard cover books, paper backs, notebook pads, pamphlets and the like.

Modern bookbinding machines are complex generally automated devices designed primarily for large scale mass production bookbinding operations in which sheets are fed to a holding device, and assembled into multiple sheet signatures or folios which are then stitched and bound to covers. These machines, however, cannot be used effectively and economically in small scale bookbinding operations in which limited numbers of books or the like are to be bound. Books of this type are commonly assembled by a sheet sorter or collator which operates in line with a duplicator or press and deposits the sheets in stacks into an array of receiving bins, jogs the stacked sheets so as to align at least one of their edges in a single plane, and secures or bonds the sheets together along the one aligned edge or spine to form a book block or filler. In the past, book covers have commonly been applied to this type of book in small scale bookbinding operations mainly by hand.

As used in this specification the terms "book block" and "filler" are synonomous and mean a stack of individual sheets, bound or stitched folios, or signatures which have been bonded together along one edge forming the spine. A "book" will be understood to comprise a "filler" or "block" and a "cover" bonded to the filler or block along its spine.

SUMMARY OF THE INVENTION

This invention provides a book cover applicator and method for applying book covers to multiple sheet fillers in which the sheets or signatures are secured together along the entire spine or at selected locations by an adhesive which also serves to bond together the filler and cover. One such adhesive, hereinafter referred to as a "hotmelt" adhesive, is an adhesive which is liquid at temperatures above its melting point but which is a solid polymer at ambient temperature. The book cover applicator of this invention can be used effectively and economically to rapidly apply covers to books in batches suitable for commercial requirements.

The book cover applicator comprises means for holding the filler and cover such that the spine and a portion of the cover are at a bonding station, and bonding means mounted adjacent the bonding station for effecting an adhesive bond formed by the spine adhesive between the spine and such cover portion. The bonding means includes means for selectably applying heat to the spine adhesive, and a setting member movable to and from an operational position in which it contacts such cover portion and urges it against the spine in a direction approximately parallel to the plane of the filler. The setting member is constructed of thermally conducted material so that when it is in its operational position, it conducts heat from the adhesive, thus shortening the setting time. A pressure member is also provided for applying pressure to the spine and to such cover portion in a direction approximately normal to the plane of the filler.

These and other features and advantages of this invention will become apparent in the detailed description and claims to follow taken in conjunction with the accompanying drawings in which like parts bear like reference numerals in the varying views. While manual feeding of the covers and fillers is illustrated and described, automated feeding or conveying apparatus may be provided if desired.

BRIEF DESCRIPTION OF THE DRAWINGS

FIG. 3 is a side elevational view of the mechanisms of FIG. 2 as positioned during the heat application phase;

FIG. 4 is a side elevational view of the mechanisms associated with the heater element;

FIG. 5 is a side elevational view of the mechanism of FIG. 2 as positioned during the set phase;

FIG. 9 is a cross-sectional view taken along the lines 9—9 of FIG. 6;

FIG. 10 is a fragmentary cross-sectional view taken along lines 10—10 of FIG. 6;

FIG. 11 is a partly broken away side elevational view of a part of the bonding mechanism;

DETAILED DESCRIPTION OF THE DRAWINGS

Figure 1:
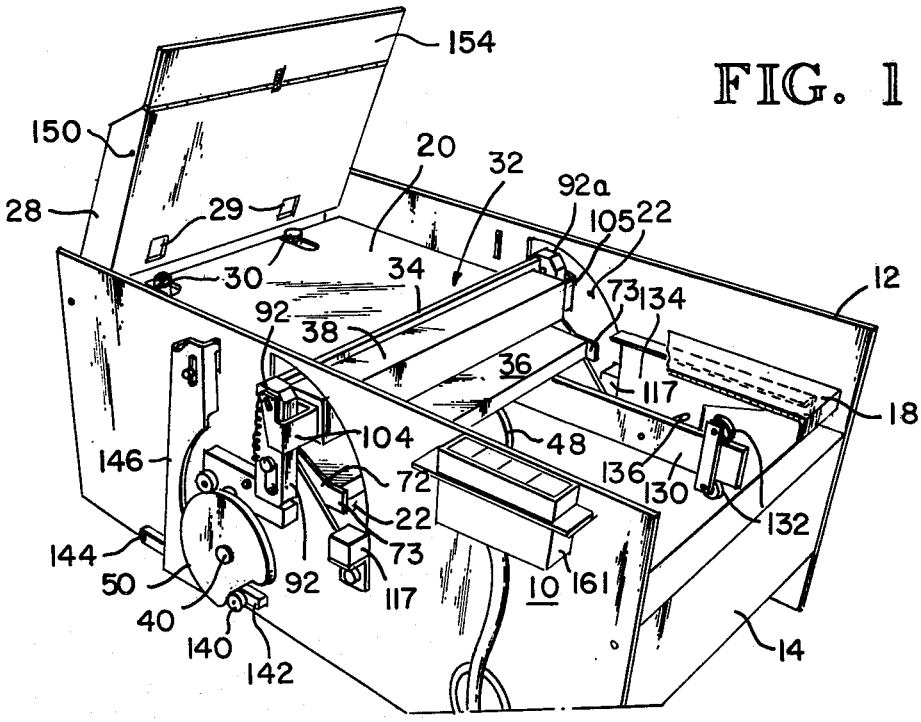
FIG. 1 is a perspective view of the book cover applicator of this invention with parts broken away.
Figure 7:
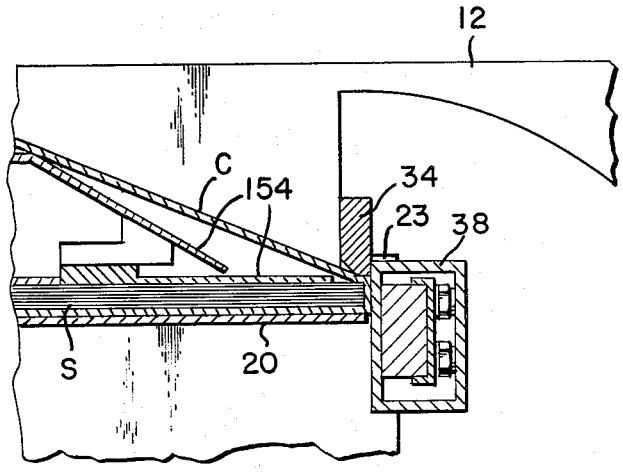
FIG. 7 is a cross-sectional view showing the relationship of parts of the bonding mechanism to the book during the set phase.

The book cover applicator illustrated herein includes a generally rectangular housing open at its upper midsection. The housing is made up of bottom 11 and two mutually parallel side walls 10 and 12 respectively spaced apart at their ends by end walls 14, 16 therebetween. Side walls 10, 12 extend above end walls 14, 16 for an appreciable distance. Forward and rear horizontal support plates 18 and 20 respectively extend between the forward and rearward portions of the side walls at a height approximately equal to that of the upper portions of the end walls. These support plates are spaced longitudinally from each other by mutually opposed generally arcuate openings 22 in the upper portions of the side walls intermediate the lengths thereof. A multiple sheet filler or block S having hot melt adhesive applied to its spine (FIG. 9) is laid flat on the rearward support plate 20 with its spine adjacent a bonding station. The bonding station extends in a line transversely across the applicator housing adjacent the rear edge of support plate 20. A cover C which is to be secured adhesively to the spine of the filler by means of the adhesive already present on the spine is also laid flat upon support plates 18 and 20, one-half underneath the filler S between the latter and the top surface of support plate 20, the other half bridging the side wall openings 22 and resting partially on the top of support plate 18. The middle portion of cover C is scored such that the cover C is foldable in half conformably about the filler spine, as shown (FIGS. 4 and 7). The filler and cover C are laid upon and removed from the book cover applicator one at a time in manual or non-continuous fashion. Automated apparatus for feeding, positioning, holding, or removing both fillers S and/or covers C may, however, be provided. The book cover applicator depicted in the example of FIG. 1 is compact, lightweight, and can be placed on a table top or the like during operation, although other means of support may be used.

The filler spine is coated entirely or at spaced intervals with a hotmelt adhesive. Such an adhesive is a liquid at temperatures above its melting point and a solid polymer at ambient temperature. Preferably the adhesive has a short setting time during which it changes from its liquid to its solid form when cooled from a temperature above its melting point to ambient temperature. For best results, the adhesive in its solid form also should provide a strong, flexible bond between the sheets of the filler S and between the filler spine and cover C. It will be recognized, of course, that other types of adhesives may be used.

The filler S and cover C are secured in position on the support plate by hold-down member 28 and by adjustable stops 30. The hold-down member is hingedly secured between upper rear corners of side plates 10, 12 for movement between a raised position (FIG. 1) and a lowered position in which it bears against the upper surface of filler S on support plate 20. Means, described below, are provided for raising and lowering support plate 20 to accommodate fillers and covers of varying thicknesses. Stops 30 extend through openings in support plate 20 for a short distance for engaging the side of the filler and cover opposite the glue bearing spine. Means, also described below, are provided for laterally varying the position of stops 30 to accommodate fillers and covers of differing widths.

Figure 6:
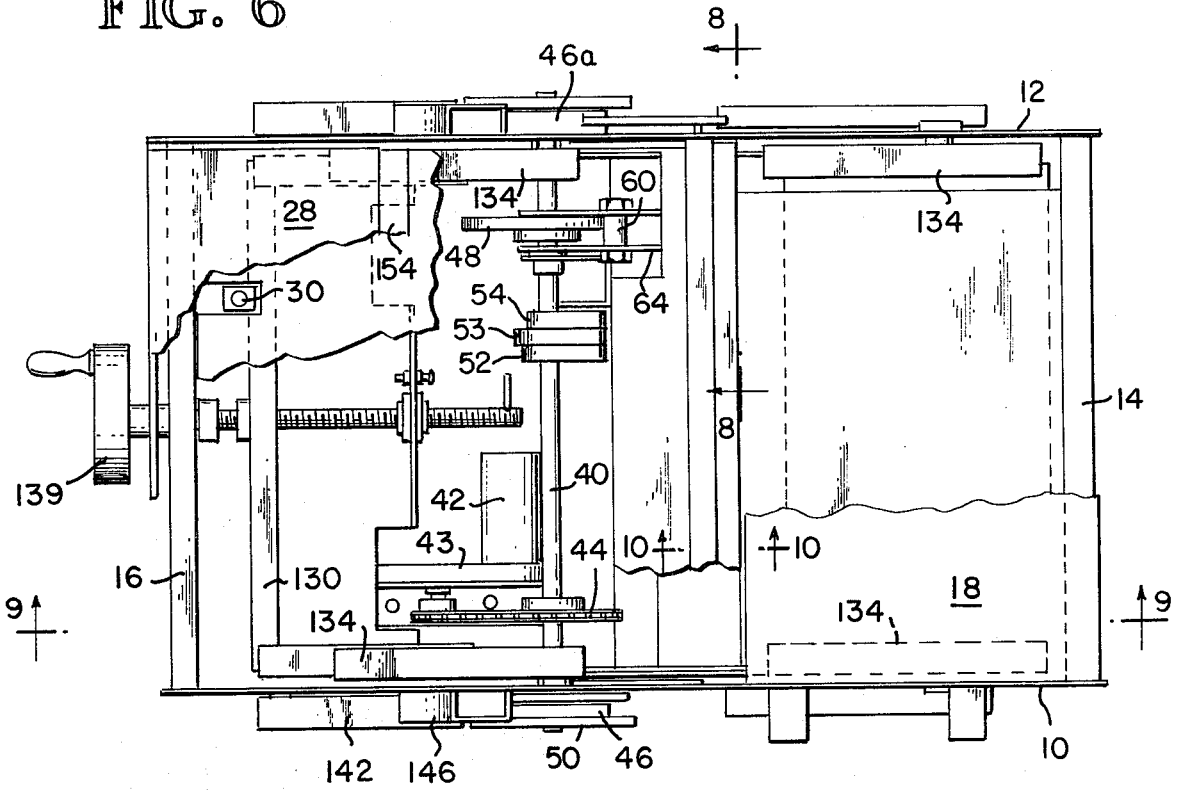
FIG. 6 is a top view of the book cover applicator of this invention with parts broken away.
Figure 8:
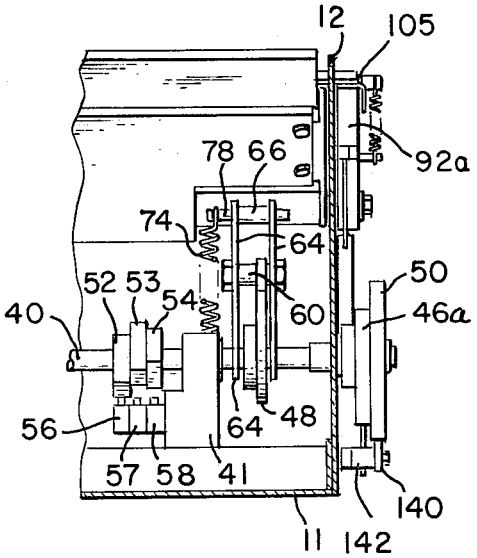
FIG. 8 is a fragmentary cross-sectional view taken along lines 8—8 of FIG. 6.

The bonding mechanism, designated generally as 32, comprises nipper bar 34, heater bar 36 and set bar 38, with their associated actuation mechanisms. All automatic machine operations are related to rotation of shaft 40 journaled in side walls 10, 12 and in block 41 mounted on bottom 11 (FIG. 8). Shaft 40 is driven by reversible electric motor 42 through gear reduction means 43 and chain and sprocket assembly 44 (FIG. 6). The shaft mounts six cams—nipper cam 46, heater cam 48, hold down cam 50, and three switch cams 52, 53, 54. The switch cams operate microswitches 56, 57, 58 respectively (FIG. 8) whose functions will hereinafter be described.

A full rotation of shaft 40 makes up one bonding cycle, which corresponds to a complete bonding operation for one book. Each bonding cycle comprises three phases—home, heat and set. During the home phase, the filler and cover may be positioned on support plate 20 while the nipper bar, heater bar and set bar are in lowered, retracted positions. During the heat phase (FIG. 4), nipper bar 34 lightly engages the spine and cover from above, applying pressure in a direction normal to the plane of the filler, while the heater bar applies heat along the spine. During set (FIG. 7), the nipper bar tightly engages the book from above while set bar 38 urges the cover horizontally against the spine, in a direction parallel to the plane of the filler, and simultaneously conducts heat from the adhesive, thus producing a rapid and even set.

Heater cam 48 is mounted on shaft 40 between side walls 10, 12, closer to rear side wall 12. As shown in FIGS. 4, 6 and 8, cam follower 60 is mounted on shaft 62 between forked arms 64. The forked ends of arms 64 slide over and engage shaft 40 while the opposite ends are connected by a link 66 to hollow outer shaft 68 which rotatably rides on inner shaft 70. Inner shaft 70 is secured between side walls 10, 12 and extends through such side walls for purposes described below. Brackets 72 are secured to outer shaft 68 near its ends and mount the heater bar 36 therebetween.

Spring 74 extends between mounting block 41 and extension 78 of link 66 (FIG. 8). Such spring biases links 66 and arm 64 downwardly, insuring that cam follower 60 is biased against and follows cam 48. As shown in FIG. 4, when follower 60 moves on to the large diameter section of cam 48, heater bar 36 will move upwardly into a position contacting cover C adjacent the glue bearing spine of filler S. The heater bar comprises an electrical resistance heater to which current is supplied by a pair of wires (not shown). When brought in contact with the filler and cover as in FIG. 4, the heater bar melts the glue contained in the filler spine. When follower 60 moves on to the small diameter of section of cam 48, the heater bar swings downwardly away from cover C into the position shown in FIG. 1.

Nipper cam 46 is mounted on shaft 40 at a point immediately outside front side wall 10. An identical cam **46*a* (FIG. 8) is mounted immediately outside rear side wall 12. The following discussion will describe the mechanisms associated with cam 46, it being understood that the mechanisms associated with cam 46*a*** are identical.

Figure 2:
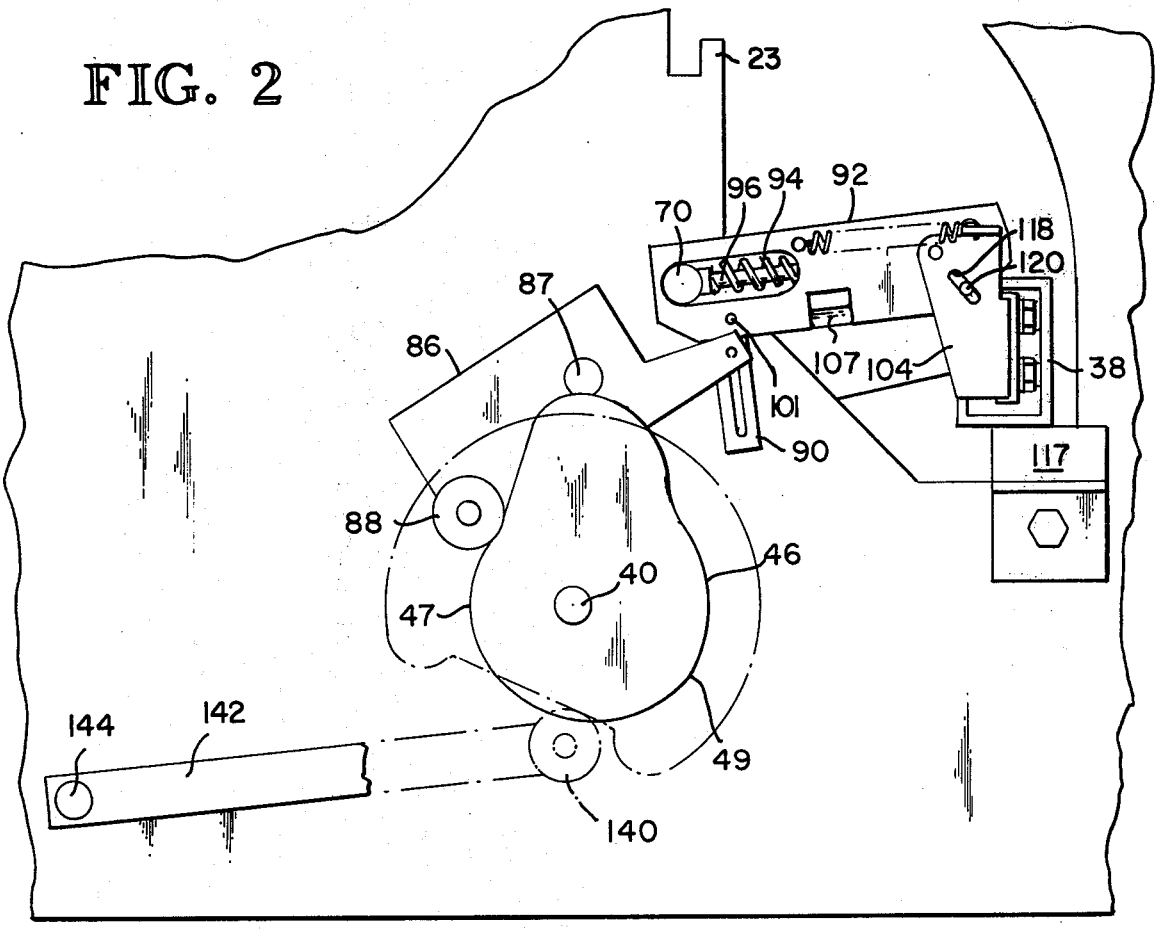
FIG. 2 is a side elevational view of the mechanisms associated with the setting member.

Rocker plate 86 is pivotally mounted at 87 to swing in a vertical plane adjacent the outer face of side wall 10. At its lower rear corner the rocker plate rotatably mounts cam follower 88, while at its lower front corner it is connected via slotted link 90 to arm 92 (FIGS. 2, 3 and 5). Arm 92 is mounted, via an elongated slot in its lower half, on the portion of inner shaft 70 which extends through side wall 10, such that the arm can move along its length relative to shaft 70 (FIGS. 3 and 5), and can also be rotated about shaft 70, as indicated in FIG. 2. Pin 96 is rotatably mounted on shaft 70 and extends upwards through spring 94 into channel 97 in arm 92 (FIG. 11). Spring 94 extends between shaft 70 and the shoulder 99 formed at the entrance to such channel, and biases arm 92 into the positions shown in FIGS. 2 and 11.

Arm 92, and a similar arm **92*a* adjacent side wall 12 mount nipper bar 34 and set bar 38 therebetween, such bars extending through arcuate openings 22 in side walls 10, 12. Such arcuate openings are formed having shoulders 23 (FIG. 2) projecting into the upper rearward portions thereof for a purpose to be described presently. Nipper bar 34 comprises an elongated member having a cross section which is rectangular with one corner cut away. A dowel 98 extends horizontally from each end of the nipper bar and such dowels are engaged in elongated openings 100 in arms 92, 92*a*, such that the nipper bar can move up and down the length of such arms for a distance equal to the length of such openings. The ends of the nipper bar itself are engaged in slots 102 (FIG. 11) which run parallel to the length of arms 92, 92*a* along the upper inside surfaces thereof. Such slots prevent rotation of the nipper bar with respect to the arms so that it is always oriented parallel to such arms, as shown in FIG. 5. Pins 96, extending through channels in arms 92, 92*a*, terminate a short distance from the under surfaces of dowels 98 (FIG. 11). Thus pins 96 insure that the nipper bar remains at approximately a fixed distance from shaft 70, regardless of the relative positions of arms 92, 92***a*.

Set bar 38 comprises a hollow elongated member of rectangular cross section resiliently mounted near its ends by brackets 104, 105, which brackets are in turn mounted on arms 92, 92*a* respectively. Preferably, the set bar is constructed of a good heat conducting material such as aluminum. The mounting between bracket 104 and set bar 38 is best seen in FIG. 10. Two columns 106 extend between facing inner surfaces of set bar 38 near each end thereof. Bracket 104 includes an extension 110 which extends into the interior of the set bar. Extension 110 is seen in cross section in FIG. 10 and contains circular openings which loosely engage columns 106 so as to permit sliding motion of the extension along the columns. Washers 108 are mounted on extension 110 concentric with such openings, and serve to space the extension away from the adjacent inner face of the set bar. Springs 112 disposed about columns 106 bias the washers against such inner face. Mounting means identical to that just described connect bracket 105 with the opposite end of set bar 38. Through such mounting means, the set bar is permitted to move a short distance against springs 112 when the set bar is brought up against the cover (FIG. 7) as hereinafter described, thus urging the cover horizontally up against the spine in a direction parallel to the plane of the filler for squaring and aligning the cover and spine as they cool.

The set bar described herein serves to conduct heat away from the spine and cover to speed the cooling process and decrease the time required to bond a single book. Other means could of course be provided to conduct heat away from the set bar, thus further reducing the bonding time for a book. Such means could include cooling fins on the set bar, a fluidic heat exchange system or others as required.

The connection between set bar mounting bracket 104 and arm 92 is illustrated in FIGS. 2, 3 and 5. Bracket 104 includes section 114 which extends parallel to the outer face of arm 92. This section contains a circular opening 116 and an elongated slot 118. Opening 116 engages dowel 98 extending from nipper bar 34 through elongated opening 100 in arm 92. Slot 118 engages pin 120 fixed in arm 92. Spring 122 connects the upper portion of bracket section 114 with a point on arm 92 intermediate its ends. The spring biases bracket 104 in a counter-clock-wise direction around pin 120 away from the position shown in FIG. 5 and into the positions shown in FIGS. 2 and 3. Bracket 105, connected to the opposite end of set bar 38, is mounted in an identical fashion to arm 92*a*.

Figure 12:
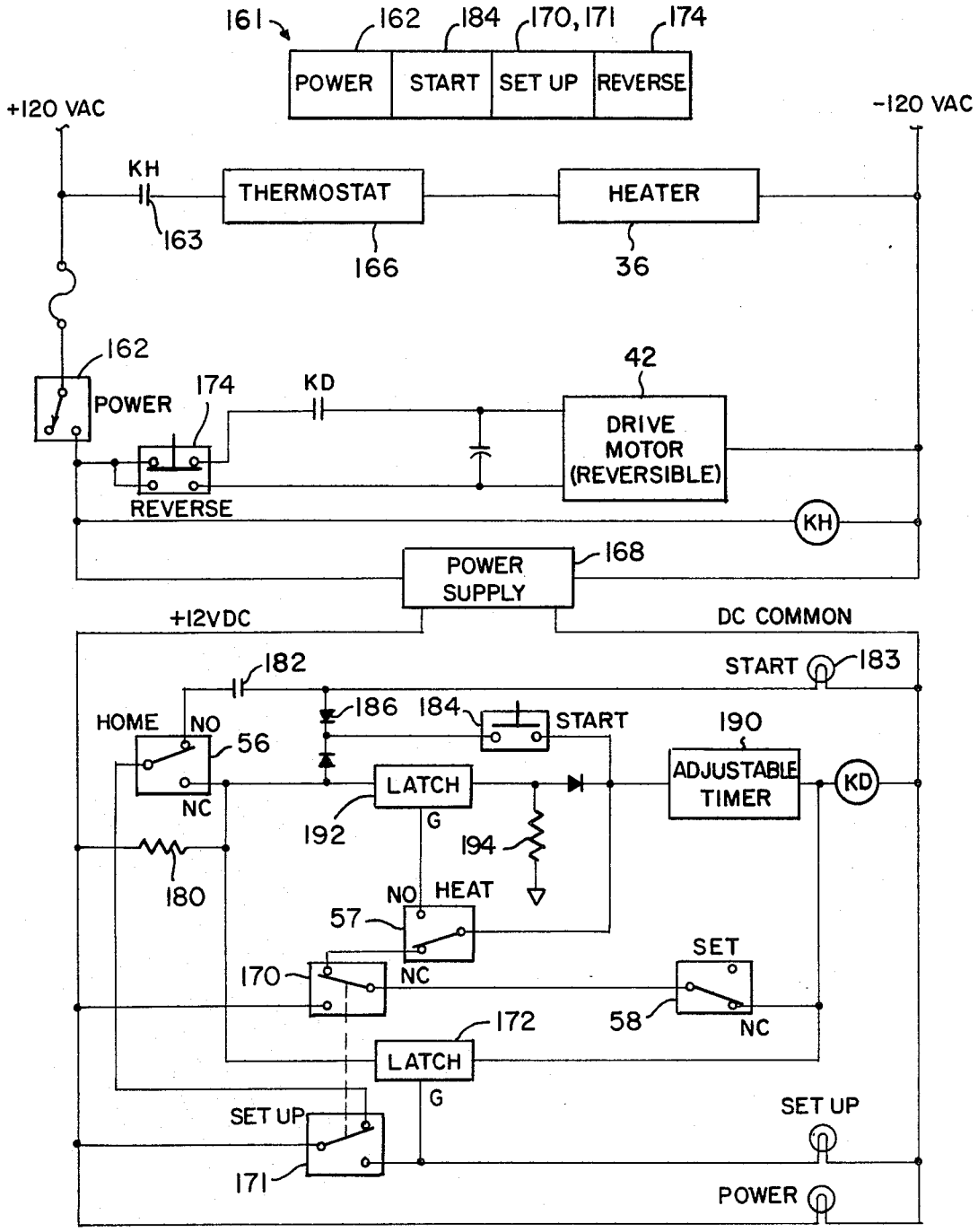
FIG. 12 is a diagram of the control system of the present invention.

The sequence of operations associated with the heater cam, the nipper cam, and the switched cams may now be described. Prior to the commencement of a bonding cycle, current must be supplied to the heater bar for a sufficient period of time to bring it up to an adequate operating temperature for the particular adhesive involved. Two thermostats are mounted with their temperature sensitive elements on the heater bar. A main thermostat 166 (FIG. 12) is set for the most desireable operating temperature for the particular adhesive used. The second thermostat, operate thermostat 182 (FIG. 12), is set for the lowest acceptable operating temperature. The operate thermostat serves to inform the control system that a bonding operation can commence.

A bonding cycle begins in the home phase, in which follower 60 (FIG. 4) rides on the small diameter portion of the heater cam, causing the heater bar to assume a lowered position as previously described. In this phase, the nipper cam and associated mechanisms are in the position shown in FIG. 2. Thus the bonding station adjacent to support plate 20 is unobstructed, and the cover and filler may be positioned on such support plate as previously described, with one half of the cover underlying the filler and the other half extending over support plate 18. In the home position, cam 52 contacts home microswitch 56. All three microswitches 56, 57 and 58 are three terminal switches having a common terminal, a normally open terminal and a normally closed terminal. Whenever any one of the switch cams contacts its associated microswitch, it breaks the contact between the normally closed terminal and the common terminal and makes a contact between the normally open terminal and the common terminal. In the home phase, the heat and set microswitches, 57 and 58 respectively, are uncontacted by their associated cams.

Depression of a start switch by the operator initiates motion of the shaft 40 in a clockwise direction, causing cam follower 60 (FIG. 4) to move on to the large diameter portion of heater cam 48 and bringing the heater bar upwards into contact with cover C adjacent the spine. The machine is now in the heat phase. As shown in FIGS. 1 and 4, heater bar brackets 72 contain upwardly extending portions 73. As the heater bar is raised to the position shown in FIG. 4, these portions 73 contact nipper bar 34, so that the nipper bar, arm 92 and set bar 38 are raised from the position shown in FIG. 2 to the position indicated in FIGS. 3 and 4. This upward motion of the nipper bar also carries cover C from its extended position partly overlying support plate 18 (FIG. 9) to its position (FIG. 4) conformably folded about filler S. At the same time, nipper cam 46 has rotated so that follower 88 has moved from the small diameter portion 47 to the intermediate portion 49 of this cam, thus rotating rocket plate 86 to take the slack out of slotted link 90 and to pull arm 92 slightly downwards (FIG. 3). This downward movement brings the nipper bar lightly to rest on the cover just above the spine, thus putting light pressure on the spine and cover in a direction normal to the plane of the filler. This small downward motion of the nipper bar positions it in the recess formed by shoulders 23 (FIGS. 2 and 7), so that the nipper bar and its associated mechanisms no longer need the heater bar to hold them in their raised position. As the machine moves from the home phase to the heat phase, cam 52 disengages from home switch 56, while cam 53 engages heat switch 57. The control system acts on these changes to stop rotation of shaft 40 for a period of time sufficient to allow the heat bar to fully melt the glue in the spine of filler S.

When the control system determines that sufficient heating time has passed, it resumes rotation of shaft 40, causing follower 60 (FIG. 4) to drop back to the lower part of the heater cam, thus lowering the heater bar. The nipper bar and set bar remain upright, engaged by shoulder 23. This further rotation of shaft 40 also causes follower 88 to move on to the large diameter portion of nipper cam 46 (FIG. 5). The machine is now in the set phase. The large upward movement of follower 88 caused by cam 46 rotates rocker plate 86 so as to pull arm 92 downward via slotted link 90 against spring 94. Because prior to such downward motion nipper bar 34 rested on the upper surface of cover C, substantial downward movement of the nipper bar will not occur, and thus dowel 98 will move upwardly in elongated opening 100. Even in the absence of a filler located beneath the nipper bar, pin 96, extending upwards from shaft 70 into contact with dowel 98, will prevent the nipper bar from further downward movement with arm 92. This latter is a machine adjustment feature explained more fully below.

Upward movement of dowel 98 relative to arm 92 will cause bracket 104 to pivot about pin 120, against the force of spring 122, so that the set bar is swung into its operational position shown in FIGS. 5 and 7, in which it abuts the back of cover C adjacent to the spine and holds such cover firmly in place against the spine while at the same time conducting heat therefrom. In this position, spring 122 causes bracket 104 to push downwards against dowel 98, thus increasing the pressure exerted by the nipper bar against the upper surface of cover C. As the machine moves from the heat to the set position, rotation of shaft 40 disengages cam 53 from heat switch 57 and causes cam 54 to engage set switch 58. The control system acts on these changes to halt rotation of shaft 40 for a period of time sufficient to allow the glue to set.

As shown in FIG. 11, slotted link 90 connecting rocker plate 86 to arm 92 is connected to arm 92 at pin 101. Means comprising nut 107 and threaded shaft 103 are provided for adjusting the position of pin 101 along the length of arm 92. This feature permits the machine to be adjusted for the most desirable amount of downward travel of arm 92 during the set phase.

When the control system determines that sufficient setting time has passed, it resumes rotation of shaft 40, returning the machine to its home phase. This rotation turns nipper cam 46 so that follower 88 rides on the small diameter portion thereof, thus permitting arm 92 to rise under the force of spring 94. When the arm rises, nipper bar 34 comes out of the slot formed by shoulder 23, permitting the entire assembly connected with arm 92, to fall back to its withdrawn position (FIG. 2), in which it rests on resilient stop members 117 mounted on the outer faces of side wall 10, 12.

The means for holding the cover and filler such that the spine and a portion of the cover are properly positioned at the bonding station generally comprises support plates 18 and 20, hold down member 28, locking means for the hold down member, adjustable stops 30, and adjustment means for the support plates and stops.

The adjustment means for the support plates comprise a U-shaped horizontal operator member 130 mounted for horizontal, longitudinal movement between spaced apart pairs of mounting pins 132 which project inwardly from side walls 10, 12. Support plates 18, 20 are mounted on a pair of vertical positioning plates 134 which in turn are mounted for vertical motion between such mounting pins with one positioning plate adjacent the inner face of each side wall between such side wall and operator 130. Each positioning plate contains a pair of inclined slots 136 which engage pins 138 extending outwardly from the operator, such that horizontal reciprocation of the operator along the longitudinal axis of the machine causes the positioning plates to be raised and lowered. The forward mid-point of the operator is threadably engaged with an external hand crank actuator 139 mounted in end wall 16. This actuator may be operated to reciprocate the operator along the longitudinal axis of the machine to simultaneously raise or lower support plates 18 and 20, in order to accommodate covers and fillers of varying thicknesses.

To accommodate and align fillers and covers of varyin widths, stops 30 are provided projecting through and above the surface of support plate 20. The stops are secured to a flange 127 via elongated slots (not shown) therein, such flange being mounted on the rearward end wall 16. The stops contain threaded extensions 128 which extend through such slots via sleeves 129 into engagement with bolts 131 beneath the flange. By such means, stops 30 can be tightened and secured in any position along such elongated slots.

In order to set up the machine for a given size filler and cover, the machine is preferably first cycled forward into its set phase, in which the nipper bar and set bar are in their fully engaged positions (FIG. 7). As previously explained, pins 96 in arms 92, **92*a* maintain the nipper bar in its operational position during the set phase whether or not a filler is present. A filler and cover are then inserted (FIG. 7) and the height of support plate 20 and the positions of stops 30** are adjusted such that the spine and adjacent cover portion are firmly engaged vertically between the nipper bar and the support plate, and the filler and cover are engaged horizontally between the set bar and stops.

Once the machine has been set up, it is returned to its home position, and the filler and cover are inserted as shown in FIG. 9. Hold down member 28, which is biased by springs (not shown) into its raised position (FIG. 1), is then manually lowered into its lowered, clamping position in which it engages the upper surface of the filler, so as to prevent buckling or bending of the cover or filler during a bonding cycle.

While continuing to hold the hold down member in its clamping position, the machine operator depresses a switch to begin a bonding cycle. As soon as the machine reaches the heat phase, locking means associated with hold down cam 50 serve to lock the hold down member in its clamping position until the bonding cycle is completed. The locking means comprises follower 140 mounted on arm 142 which is pivotally mounted to side wall 10 at 144. It will be understood that similar hold down cam and locking means are mounted adjacent to side wall 12. Vertical connecting arm 146 is mounted on arm 142 and terminated in a shoulder (not shown) which can project inwardly through an opening in side wall 10 into opening 150 in the hold down member, to prevent such member from moving from its clamping to its raised position under the force of its biasing springs. A spring (not shown) biases arm 142 upwards to insure that follower 140 follows the hold down cam.

Hold down member 28 contains openings 29 in its under side for receiving adjustable stops 30. It also contains pressure plate 154 pivotally mounted to its forward edge. The pressure plate is maintained by spring means in a position parallel to the lower face of the hold down member. The pressure plate can, however, bend downwardly against such spring means as the hold down member is moved from its clamping to its raised position after a bonding cycle, so that cover C is not bent back excessively by the rising hold down member (FIG. 7). FIG. 7 also illustrates the purpose of the cut away portion of nipper bar 34, which is to prevent the nipper bar from bending the cover C against pressure plate 154 during a bonding operation.

An electronic control system (FIG. 12) is provided for automatic control of machine operations. The electronic hardware 160 is located beneath support plate 18. A set of four switches 161 available to the operator is shown diagramatically at the top of FIG. 12.

Machine operation is commenced by closing power switch 162 which connects the 120 VAC supply current to heater relay KH, thus closing relay contacts 163 and supplying power to heater 36. Main thermostat 166 is provided to maintain the heater at its desired operating temperature, the temperature sensor element thereof being located on the heater bar. Closing the power switch also activates the DC power supply 168.

As explained above, adjustments to accomodate given book sizes are best made with the machine in its set phase. The control system therefore includes means to enable the machine operator to cycle the machine forward into this phase for setup purposes. Such means is activated by depressing the setup switch, comprised of two interconnected SPDT switches 170 and 171. Switches 170 and 171 are shown in their nonsetup positions in FIG. 12. When switch 171 is depressed, it applies a voltage to gate G of latch 172, thus turning on the latch. The simultaneous depression of switch 170 supplies current to drive relay KD via set switch 58, thus activating motor 42 through switch 174. The motor will continue on until the machine reaches the set phase of its cycle, at which point set switch 58 opens, cutting power to the motor. The machine is now ready for setup. When setup is complete, the operator moves setup switches 170 and 171 to their FIG. 12 position, applying current to drive relay KD through switch 171, home switch 56, and latch 172. Resistor 180 allows enough current to flow through latch 172 to hold it on after voltage is removed from its gate. When the machine reaches its home position, the home switch changes to its normally open position, breaking the current path for KD and again stopping the machine, this time at its home position.

Cover application may be commenced as soon as the heater bar has reached a satisfactory operating temperature. When such temperature is reached, the contacts of operate thermostat 182 close, turning on start light 183. The operate thermostat is located on the heater bar and is set at a temperature somewhat below that of the main thermostat 166. Depressing start switch 184 then creates a current path for relay KD through switch 171, home switch 56, diode 186, start switch 184, heat switch 57, switch 170 and set switch 58, such that the machine begins to cycle. During this time the terminals of adjustable timer 190 are shorted together. This timer has the characteristic that it will appear to be an open circuit between its terminals for a presettable period of time after a voltage difference is impressed therebetween.

When the heat bar reaches its heating position in contact with the book cover, home switch 56 and heat switch 57 both reverse their positions. Up until this time, releasing the start switch will cause machine operation to halt, since the only current path for relay KD will be through such switch. This is a safety feature which permits the operator to instantly stop the machine should a jam occur as the heater and nipper bars are raised towards their operational positions. As soon as the home and heat switches change position, however, latch 192 comes on and by-passes the start switch. The heat switch now isolates the terminals of adjustable timer 190, and thus the motor does not operate until the timer times out and creates a current path from latch 192 to relay KD. During this time the heat bar is in contact with the book cover and melting the glue.

When the timer does conduct, it restarts motor 42, dropping the heat bar into its lowered position and bringing the set bar into its operational position. At this time the heat switch and set switch change positions, the former occuring slightly before the latter. When the heat switch goes to its NC position, it shorts the terminals of timer 190, resetting it. Resistor 194 provides a path for an amount of current sufficient to hold latch 192 on. Set switch 58 then opens, restarting the timer. Relay KD will now be de-energized for the period of time set by the timer, during which time the set bar will align the filler and cover and cool the glue. When the timer times out, it will re-energize relay KD, and the machine will cycle until the set switch closes and the home switch goes to its NO position, at which point the current path through latch 192 will be broken and the motor will stop. The machine has now completed a full cycle and is ready for another cover application or setup sequence.

Motor 42 is a reversible electric motor and can be made to run in reverse by operating switch 174. In the reverse mode, motor operation is independent of drive relay KD and is controlled entirely by the machine operator.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

What is claimed is:

1. A book cover applicator for applying a cover to a filler having a spine coated with a heat activatable adhesive which sets upon cooling, said applicator comprising:

means for holding the filler and cover with the spine and a portion of the cover at a bonding station; and bonding means mounted adjacent said bonding station for effecting an adhesive bond formed by the spine adhesive between the spine and said cover portion, said bonding means including means for selectively applying heat to the spine adhesive, a setting member moveable to and from an operational position in which it contacts said cover portion and urges said cover portion against the spine in a direction approximately parallel to the plane of the filler, said setting member being constructed of thermally conductive material so that when it is in its operational position it conducts heat from the adhesive, and actuation means for moving the setting element into and out of its operational position, the actuation means including means for moving the setting element into its operational position after application of heat to the spine adhesive.

2. The book cover applicator of claim 1, wherein the bonding means further comprises means for applying a compressional force on the spine and on said cover portion in a direction approximately normal to the plane of the filler.

3. The book cover applicator of claim 2, wherein the means for applying a compressional force on the spine and on said cover portion comprises an elongated pressure element mounted for movement to and from an operational position in engagement with said cover portion.

4. The book cover applicator of claim 3, wherein the setting member comprises an elongated setting element.

5. The book cover applicator of claim 4, wherein the means for selectively applying heat to the spine adhesive comprises an elongated heater element moveable to and from an operational position in thermally conductive relation with the spine adhesive.

6. The book cover applicator of claim 5, wherein the actuation means includes means for bringing the pressure element into its operational position when either the heating element or the setting element is in its respective operational position, such that the pressure exerted by the pressure element on the spine and on said cover portion is greater during the time that the setting element is in its operational position than during the time that the heater element is in its operational position.

7. The book cover applicator of claim 6, wherein a plurality of actuation arms mount both the pressure element and the setting element.

8. The book cover applicator of claim 7, wherein the means for holding the filler and cover comprises a support surface for supporting the cover and filler, a hold-down member having an outline which substantially registers with the outline of the filler, and means mounting said hold-down member adjacent said support surface for pivotal movement to and from a clamping position in which it engages the filler.

9. The book cover applicator of claim 8, wherein the support surface is adjustable in height with respect to the bonding means for supporting fillers and covers of varying thicknesses, and wherein the means for holding the filler and cover further comprises stop means upstanding from the support member and adjustable in distance from the bonding means, for accommodating fillers and covers of varying widths.

10. A book cover applicator for applying a cover to a filler having a spine coated with a selectively activatable adhesive, said activator comprising:

means for holding the filler and cover with the spine and a portion of the cover at a bonding station; and bonding means mounted adjacent said bonding station for effecting an adhesive bond formed by the spine adhesive between the spine and said cover portion, said bonding means including means for selectively activating the spine adhesive, a setting element moveable to and from an operational position in which it contacts said cover portion and urges the said cover portion against the spine in a direction approximately parallel to the plane of the filler, and actuation means for moving the setting element into and out of its operational position, the actuation means including means for moving the setting element into its operational position after activation of the spine adhesive.

11. The book cover applicator of claim 10, wherein the bonding means further comprises a pressure element moveable to and from an operational position in which it exerts a compressional force on the spine and said cover portion in a direction approximately normal to the plane of the filler.

12. The book cover applicator of claim 11, wherein the actuation means further includes means for positioning the pressure element in its operational position during a first time interval when the adhesive is being activated and during a second time interval when the setting element is in its operational position, said compressional force being greater during the second time interval than during the first time interval.

13. In a book cover applicator for applying a cover to a filler having a spine coated with a selectively activatable adhesive, said applicator having a setting element moveable to and from an operational position in which it contacts said cover and urges said cover against the spine in a direction approximately parallel to the plane of the filler, actuation means for moving the setting element into and out of its operational position, the actuation means including a pair of arms between which the setting element is pivotally mounted, said arms being moveable between a first position in which the setting element is remote from the spine and cover and a second position in which the setting element is adjacent to the spine and cover, and means for causing pivotal motion of the setting element into and out of its operational position in response to lengthwise motion of said arms when said arms are in their second position.

14. A method for applying a cover to a filler having a spine covered with a selectively activatable adhesive, said method comprising:

holding the filler and cover with the spine and a portion of the cover at a bonding station;

activating the spine adhesive; by moving an adhesive activation element into an operational position;

moving said activation element out of said operational position; and then contacting said cover portion with a setting element such that the setting element urges said cover portion against the spine in a direction approximately parallel to the plane of the filler.

15. A method for applying a cover to a filler having a spine coated with a selectively activatable adhesive, said method comprising:

holding the filler and cover with the spine and a portion of the cover at a bonding station;

activating the spine adhesive while simultaneously contacting said cover portion with a pressure element such that the pressure element applies a compressional force on the spine and said cover portion in a direction approximately normal to the plane of the filler; and then contacting said cover portion with a setting element such that the setting element urges said cover portion against the spine in a direction approximately parallel to the plane of the filler, and simultaneously increasing the compressional force exerted on the spine and said cover portion by the pressure element.

* * * * *